US005764042A

United States Patent [19]

Beier et al.

[11] Patent Number: 5,764,042

[45] Date of Patent: Jun. 9, 1998

[54] CONTROLLED POWER SUPPLY SOURCE

[75] Inventors: Ralf Beier; Axel Näthe; Michael Ramm, all of Hamburg, Germany

[73] Assignee: U.S. Philips Corporation, New York, N.Y.

[21] Appl. No.: 818,139

[22] Filed: Mar. 13, 1997

[30] Foreign Application Priority Data

Mar. 14, 1996 [DE] Germany ..... 196 09 971.4

[51] Int. Cl.[6] ..... G05F 3/16

[52] U.S. Cl. ..... 323/316; 323/315

[58] Field of Search ..... 323/311, 312, 323/313, 314, 315, 316

[56] References Cited

U.S. PATENT DOCUMENTS 4,352,056 9/1982 Cave et al. ..... 323/314
4,496,885 1/1985 Nitschke ..... 323/315 X

FOREIGN PATENT DOCUMENTS 4231571 3/1994 Germany .

*Primary Examiner*—Peter S. Wong
*Assistant Examiner*—Y. J. Han
*Attorney, Agent, or Firm*—Robert M. McDermott

[57] ABSTRACT

A controlled power supply source is described, which has a parallel control member having a controllable semiconductor component whose load path is arranged between output terminals of the power supply source and whose control input is connected to an output of a control device, the control device having a reference input for supplying a reference voltage. The control device has a control amplifier which is fed from a current bank having at least one constant current source, an actual value input of said control amplifier receiving the voltage between the output terminals of the power supply source, and a nominal value input receiving the reference voltage from the reference input of the control device. An output of the control amplifier constitutes the output of the control device which further has a preliminary current stage which, dependent on the difference between the voltages at the actual value input and at the nominal value input of the control amplifier, applies a preliminary current to this control amplifier, which preliminary current is applied to the control input of the semiconductor component at least partly via the output of the control device. This provides the possibility of controlling high power supply voltages, and when the source is switched on, only a very short period of time is required to reach the linear operating range of the parallel control member.

20 Claims, 1 Drawing Sheet

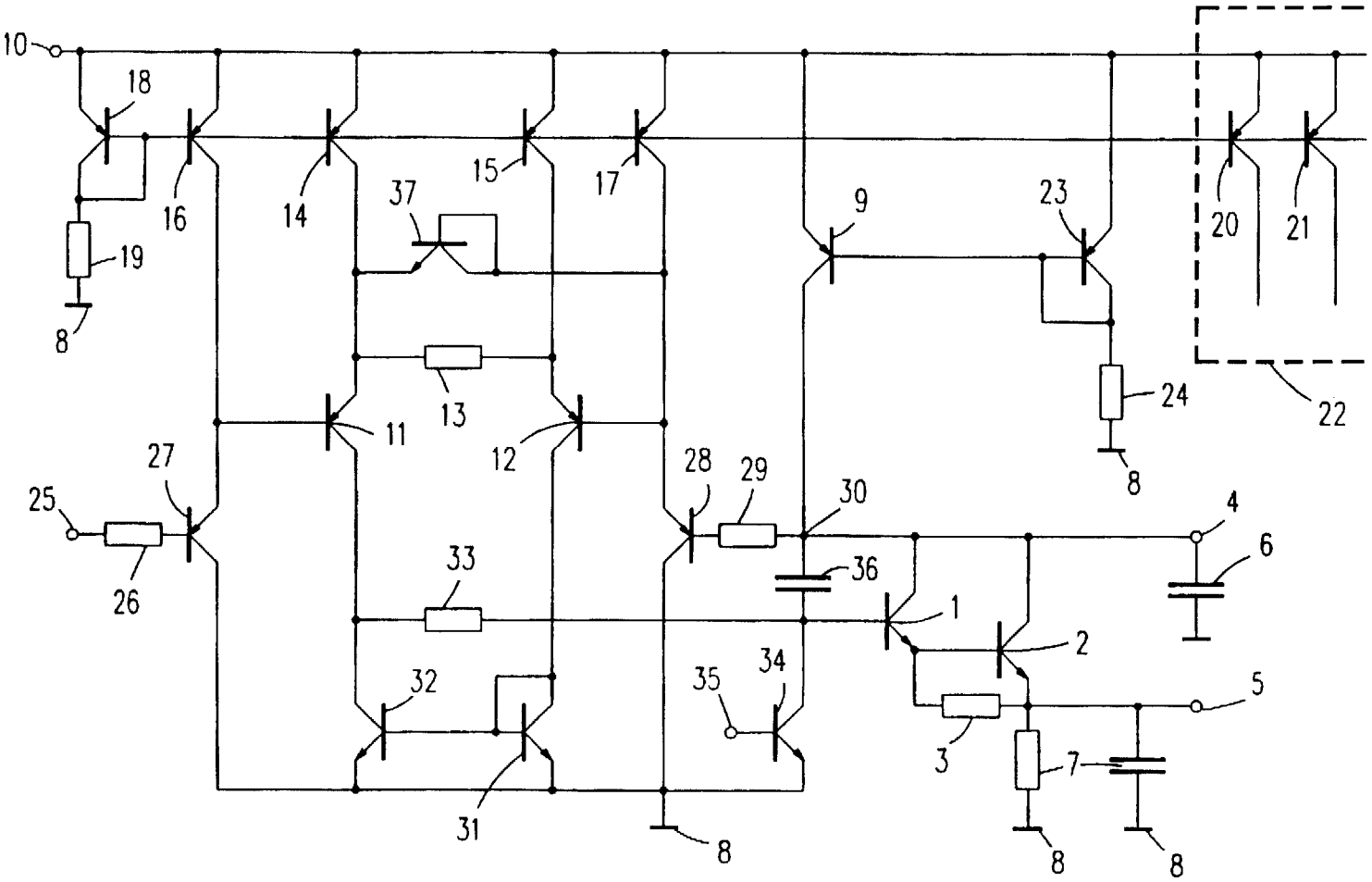
10
18
19
8
16
14
15
17
9
23
24
8
22
21
20
37
13
11
12
28
29
30
36
27
26
25
33
32
31
34
35
8
1
2
3
7
8
4
6
5
8

CONTROLLED POWER SUPPLY SOURCE

BACKGROUND OF THE INVENTION

1. Field of the Invention

The invention relates to a controlled power supply source comprising a parallel control member having a controllable semiconductor component whose load path is arranged between output terminals of the power supply source and whose control input is connected to an output of a control device, the control device having a reference input for supplying a reference voltage.

2. Description of the Related Art

DE-OS 42 31 571 discloses an integrative shunt control with a controllable semiconductor component, whose load path is arranged between the terminals of a power supply source and whose control input is connected to the output of a control device, and a reference voltage source to which the reference input of the control device is connected. The stability of this control, particularly with a connection to a power supply source having a complex internal resistance is enhanced by driving a transistor in the control device up to its saturation limit.

SUMMARY OF THE INVENTION

It is an object of the invention to provide a controlled power supply source of the type described in the opening paragraph, comprising a parallel control member, which is adapted to control high power supply voltages and only requires a very short period of time to reach its linear operating range when it is switched on, i.e. when the control device is put into operation or is activated.

According to the invention, in a controlled power supply source of the type described in the opening paragraph, this object is solved in that the control device comprises a control amplifier which is fed from a current bank having at least one constant current source, an actual value input of said control amplifier receiving the voltage between the output terminals of the power supply source, and a nominal value input receiving the reference voltage from the reference input of the control device, an output of the control amplifier constituting the output of the control device, and the control device comprising a preliminary current stage which, dependent on the difference between the voltages at the actual value input and at the nominal value input of the control amplifier, applies a preliminary current to said control amplifier, which preliminary current is applied to the control input of the semiconductor component at least partly via the output of the control device.

In this case, the current bank represents a circuit arrangement which can usually supply several direct currents which are stabilized simultaneously with each other and thus are in a preferred, constant ratio to each other. This is advantageously achieved in that such a current bank comprises at least one constant current source, in which all constant current sources of the current bank are jointly stabilized. An advantageous embodiment of such a current bank comprises semiconductor components, particularly transistors in the form of a current mirror having an input and preferably a plurality of outputs. Due to the fixed, predetermined proportionality between the fixed direct currents supplied from the outputs, more comprehensive circuit arrangements requiring a plurality of DC sources can also be fed with precision.

Particularly in such a supply by means of constant current sources (for example, from a current bank) it may occur that transients require an undesirably large period of time when a circuit arrangement supplied in this way is put into operation, for example, due to changes of charge of the capacitances in the circuit arrangement, because, due to the predetermined currents, the required quantities of charge are not available until after given periods of time have elapsed. A control device, fed in such a way, for a controlled power supply source of the type described in the opening paragraph would then have a delayed transient response, i.e. a disproportionately long period of time would be required to reach the linear operating range.

The invention provides a considerably shorter transient time when the controlled power supply source is put into operation, by virtue of the preliminary current supplied by the preliminary current stage, resulting in considerably faster charge reversals upon transients. The power supply source according to the invention is thus ready for operation in a very short time after it has been switched on.

The preliminary current stage preferably supplies the preliminary current when the voltage at the actual value input exceeds the voltage at the nominal value input by a predetermined difference. The parallel control member which is arranged with the load path of the semiconductor component comprised therein between the output terminals of the power supply source, generates, in operation, a power supply voltage at these output terminals, which power supply voltage is lower than the voltage adjusting between the output terminals of the power supply source when the voltage is applied to these output terminals but the parallel control member is not operative. Consequently, for the operation of the parallel control member, the voltage at the nominal value input of the control amplifier (nominal value) is lower than the voltage at the actual value input (actual value) resulting when the parallel control member is rendered inoperative. When the parallel control member is put into operation, the voltage at the actual value input will therefore be initially larger than the voltage at the nominal value input. A preliminary current is then initially supplied, but this current is interrupted when the voltage at the actual value input decreases due to the action of the parallel control member and falls below a value which is above the voltage at the nominal value input by the predetermined difference value. The difference value is predetermined in such a way that, on the one hand, a rapid transient response is achieved but, on the other hand, overshoots are avoided. A transient time which is as short as possible is then achievable.

In a further embodiment of the controlled power supply source according to the invention, the preliminary current stage is fed from one of the constant current sources of the current bank. A defined preliminary current can then be adjusted, which leads to a higher stability as far as tendencies towards oscillations of the control device are concerned. When the preliminary current only flows when the voltage at the actual value input exceeds the voltage at the nominal value input by the predetermined difference value, so that the preliminary current also flows when the parallel control member is inoperative, the current bank is also fed with the preliminary current when the other parts of the control device, particularly the control amplifier, are rendered inoperative and thus do not take up any current from the current bank. It can thereby be prevented that the current bank transistors used as additional constant current sources are saturated when the control amplifier is rendered inoperative and thus affect the function of the overall current bank. This is particularly advantageous when the current source is not only to feed the control device but also further circuit parts whose function must be ensured independently of the state of operation of the control device.

The power supply source according to the invention is advantageously implemented in such a way that the control amplifier comprises an emitter-coupled pair of transistors fed by at least one of the constant current sources of the current bank, one of said transistors being controlled by the actual value input and the other being controlled by the nominal value input, and a current combination stage which applies the sum of the currents conveyed by the transistors to the output of the control device. For each transistor of the emitter-coupled pair, the control amplifier particularly comprises an emitter-follower stage fed by a respective constant current source of the current bank, via which stage the actual value input and the nominal value input are connected to the transistors of the emitter-coupled pair controlled by said inputs, while the preliminary current stage further comprises a diode arrangement which is connected, in the forward direction, by the constant current source of the emitter-follower stage connected to the actual value input, to the emitter of that transistor of the emitter-coupled pair which is controlled by the nominal value input. This configuration leads to a very simple and reliable preliminary current stage in which the predetermined difference value between the voltages at the actual value input and the nominal value input, at which the preliminary current flows when this value is exceeded, is determined by one or more diode forward voltages.

BRIEF DESCRIPTION OF THE DRAWING

The FIGURE shows the controlled power supply source of the present invention.

DESCRIPTION OF THE PREFERRED EMBODIMENT

These and other aspects of the invention are apparent from and will be elucidated with reference to the embodiments described hereinafter.

In the drawings:

The sole FIGURE shows an embodiment of the controlled power supply source according to the invention. This source comprises a parallel control member having a controllable semiconductor component constituted as a Darlington circuit of two NPN transistors 1, 2. A resistor 3 connects the emitters of the transistors 1 and 2 of the Darlington circuit. It is arranged with its load path between a first output terminal 4 and a second output terminal 5. In operation, the power supply voltage to be stabilized by the parallel control member is taken from the output terminals 4, 5. A capacitor 6 is connected between the first output terminal 4 and ground 8 and an RC member 7 is connected between the second output terminal 5 and ground 8.

The first output terminal 4 is connected to a common power supply line 10 via the load path of a first current source transistor 9. The power supply line 10 may be connected to a battery or to the mains, or the like, for the supply of electrical energy. The voltage at the power supply line 10 does not need to be stabilized.

The power supply source shown in the FIGURE comprises a control device with a control amplifier. This control amplifier comprises an emitter-coupled pair of PNP transistors 11, 12, in which the emitters are coupled via a resistor 13. The emitters of the PNP transistors 11 and 12 are connected to the power supply line 10 via a second and a third current source transistor 14 and 15, respectively. The current source transistors 14, 15 are parts of a current bank which also comprises a fourth and a fifth current source transistor 16 and 17, respectively, as well as a control transistor 18. All current source transistors 14 to 17 and the control transistor 18 are implemented as PNP transistors, whose emitters are connected to the power supply line 10 and whose bases are interconnected. Moreover, the interconnected bases are connected to the collector of the control transistor 18 and to a terminal of a resistor 19 which also forms part of the current bank and has its second terminal connected to ground 8. With a similar connection as the current source transistors 14 to 17, the current bank may comprise further current source transistors 20, 21 which are used in another circuit arrangement 22, shown in broken lines, for supplying constant -currents which are in a fixed correlation with respect to the direct currents supplied by the current source transistors 14 to 17.

In the circuit arrangement shown, the first current source transistor 9 is not incorporated in the current bank 14 to 21 but is connected with its own control transistor 23 and its own resistor 24 to ground 8. Here, the control transistor 23 is also arranged as a diode due to the connection of its base and its collector, while the bases of the first current source transistor 9 and the control transistor 23 are interconnected, and the series arrangement between the control transistor 23 implemented as a PNP transistor and arranged as a diode and the resistor 24 connects the power supply line 10 to ground 8. In a modification of the embodiment shown, the control transistor 23 and the resistor 24 may be dispensed with and the base of the first current source transistor 9 may be connected to the base of the control transistor 18 so that also the first current source transistor 9 forms part of the current bank.

A reference voltage for adjusting the actual value of the voltage at the first output terminal 4 is applied to the control amplifier at the base of the first PNP transistor 11 of the emitter-coupled pair from a reference input 25 which, in the present embodiment, is identical to the nominal value input. To this end, the reference input 25 is connected via an input resistor 26 to the base of a PNP transistor 27 constituting a first emitter-follower stage whose emitter is connected to the base of the first PNP transistor 11 of the emitter-coupled pair of the control amplifier and to the collector of the fourth current source transistor 16 of the current bank. Consequently, the first emitter-follower stage 27 is fed by the fourth current source transistor 16 which constitutes one of the constant current sources of the current bank. The collector of the PNP transistor 27 constituting the first emitter-follower stage is connected to ground 8. In a corresponding manner, a PNP transistor 28 constitutes a second emitter-follower stage. The emitter of the transistor 28 constituting the second emitter-follower stage is connected to the collector of the fifth current source transistor 17 and to the base of the second PNP transistor 12 of the emitter-coupled pair of the control amplifier. The collector of the transistor 28 is also connected to ground 8. The base of transistor 28 is connected to the first output terminal 4 via an associated input resistor 29. In the present embodiment, the first output terminal 4 also constitutes the actual value input of the control amplifier and, for the sake of clarity, this actual value input is denoted by the reference numeral 30 in the FIGURE. Similarly as the first emitter-follower stage 27, the second emitter-follower stage 28 is also fed from the current bank. The actual value of the voltage at the output terminal 4 is applied to the second transistor 12 of the emitter-coupled pair via this current bank (and the input resistor 29).

The control amplifier also comprises a current combination stage by which the currents conveyed by the transistors 11, 12 of the emitter-coupled pair are combined to an output current which is applied to the base of the NPN transistor 1 of the Darlington circuit, i.e. to the control input of the semiconductor component of the parallel control member. This current combination stage comprises a current mirror which consists of two NPN transistors 31, 32 whose bases are interconnected and whose emitters are connected to ground 8. The collector of the first NPN transistor 31 of the current mirror is connected to the collector of the second PNP transistor 12 of the emitter-coupled pair of the control amplifier. Due to a connection between the base and the collector, the first NPN transistor 31 of the current mirror is arranged as its input. The collector of the second NPN transistor 32 of the current mirror constitutes its output and is connected to the collector of the first PNP transistor 11 of the emitter-coupled pair. Moreover, this junction point is connected to an output resistor 33 via which the current combination stage is connected in said manner to the base of the transistor 1.

The current mirror 31, 32 of the current combination stage 31 to 33 combines the collector current of the second PNP transistor 12 of the emitter-coupled pair with the collector current of the first PNP transistor 11 so that the sum of these currents flows in the output resistor 33, which sum includes the currents with different signs. For the case where the voltages at the nominal value input (reference input) 25 and at the actual value input 30 correspond, the bases of the transistors 11, 12 of the emitter-coupled pair are also impressed with corresponding voltages. The collector currents of these transistors are then equal and the output resistor 33 will become currentless so that the Darlington circuit 1, 2 changes over to the blocked state. When the voltage at the actual value input 30 exceeds the value of the voltage at the nominal value input 25, a current flows in the collector of the first PNP transistor 11 of the emitter-coupled pair, which is larger than the current flowing in the collector of the second PNP transistor 12. The difference between these currents is applied to the base of the NPN transistor 1 of the Darlington circuit via the output resistor 33. This Darlington circuit thereby becomes conducting and reduces the voltage at the actual value input 30. In this way, the voltage is maintained constant at the first output terminal 4.

The parallel control member in the circuit arrangement shown may be switched off by means of a switching transistor 34, i.e. it may be rendered inoperative, in which state the semiconductor component consisting of the transistors 1, 2 remains blocked independently of the voltage at the actual value input 30. To reach this state, a switching voltage is applied to the switching transistor 34 via a switching input 35. The switching input 35 is connected to the base of the switching transistor 34. The switching voltage turns on the switching transistor 34. As a result, the current in the output resistor 33 is directly applied to ground 8 and the Darlington circuit remains blocked. The voltage which is present at the power supply line 10 then adjusts itself at the first output terminal 4 via the first current source transistor 9. However, if the supply of the switching voltage to the switching input 35 is interrupted, or if this input conveys a low switching voltage (i.e. the switching input 35 is connected to ground 8), then the switching transistor 34 is turned off and the parallel control member shown in the FIGURE is active.

The embodiment shown in the FIGURE also includes a capacitor 36 stabilizing the collector-base voltage of the transistor 1 of the Darlington circuit and being arranged between the actual value input 30 and the connection between the output resistor 33, the base of the transistor 1 and the collector of the switching transistor 34. Moreover, the capacitor 36 generates a positive feedback of the actual value input 30 when the switching transistor 34 switches the parallel control member, so that the operations of switching to the active or inactive state of the parallel control member are accelerated. Particularly when integrating the parallel control member on a semiconductor body, the dimensioning of the capacitor 36 is of course subjected to a narrow limit, and the reversal of the charge of the capacitor 36 following after each change of the switching voltage at the switching input 35 via the current source transistors of the current bank—and also the first current source transistor 9—takes up a disproportionately long period of time, owing to the fixed currents of these current source transistors.

According to the invention, the insertion of a preliminary current stage 37 yields a significant acceleration of these charge reversals and of the overall switching of the parallel control member, particularly when it is put into operation, i.e. when the switching transistor 34 is switched to its turned off state. In the embodiment shown in the FIGURE, the preliminary current stage 37 consists of an NPN transistor arranged as a diode, whose collector (and base) are connected to the collector of the fifth current source transistor 17 and whose emitter is connected to the emitter of the first PNP transistor 11 of the emitter-coupled pair. The preliminary current stage 37 thus constitutes a diode arrangement which is connected, in the forward direction, by the constant current source 17 of the emitter-follower stage 28 connected to the actual value input 30 to the emitter of the transistor 11 of the emitter-coupled pair, which transistor is controlled by the nominal value input 25.

The preliminary current stage 37 becomes conducting when the collector of the fifth current source transistor 17 conveys a voltage which is twice as high as the base-emitter forward voltage of a transistor, as compared with the voltage conveyed by the collector of the fourth current source transistor 16, or in other words: the voltage at the base of the transistor 12 controlled by the actual value input 30 is higher by twice the forward voltage as compared with the voltage at the base of the transistor 11 controlled by the nominal value input 25. Since, in this state of operation, the emitter-follower stages 27, 28 are still fed with direct currents by the associated current source transistors 16, 17, the described voltage difference is also present between the actual value input 30 and the nominal value input 25. When this difference, which is predeterminable by means of the layout of the preliminary current stage 37 and variable by means of a series arrangement of a plurality of transistors connected as diodes, is exceeded, the preliminary current starts flowing through the preliminary current stage 37. As a result, the collector current of the first PNP transistor 11 is increased and the collector current of the second PNP transistor 12 is decreased. The preliminary current thereby increases the current through the output resistor 33 so that the Darlington circuit 1, 2 is driven towards its conducting state at a faster rate. In the reverse process, i.e. when the parallel control member is put into operation by turning off the switching transistor 34, the preliminary current, starting from a high voltage at the actual value input 30, flows until the voltage at the actual value input 30 is higher by twice the forward voltage of the transistors as compared with the voltage at the nominal value input 25. The preliminary current is thus interrupted when the actual value (voltage at the actual value input 30) approaches the nominal value (voltage at the nominal value input 25). The transient of the parallel control member is thus accelerated at the first moment by the preliminary current, but this acceleration is ended when the transient state is approached, such that the parallel control member changes over to its linear operating range without any overshoots.

In the inoperative state of the parallel control member, in which the switching transistor 34 is turned on, the preliminary current from the preliminary current stage 37 is applied to ground 8 via the first PNP transistor 11, the output resistor 33 and the switching transistor 34. On the one hand, it has thus no influence on the control of the Darlington circuit 1, 2 but, on the other hand, there is a fixed coupling between the voltages at the collector of the fifth current source transistor 17 and at the reference input (nominal value input) 25 because also the PNP transistor 27 of the first emitter-follower stage is further turned on. The voltage at the collector of the fifth current source transistor 17 is clamped at a value which is higher by three times the value of the forward voltage of the transistors as compared with the reference voltage at the reference input 25. By preventing a further voltage rise at the collector of the fifth current source transistor 17, a saturation of the current bank 14 to 21 is also avoided. The current bank thus also remains operative, even when the parallel control member is rendered inoperative, in so far as direct currents supplied by the further current source transistors 20, 21 are not affected by the switching of the parallel control member. Via the base-emitter path of the second PNP transistor 12, the preliminary current stage 37 also similarly counteracts a saturation of the third current source transistor 15 whose collector is clamped at a value in a corresponding manner, which value is higher than the reference voltage by an amount which is maximally four times the forward voltage of the transistors.

We claim:

1. A controlled power supply source comprising a parallel control member having a controllable semiconductor component whose load path is arranged between output terminals of the power supply source and whose control input is connected to an output of a control device, the control device having a reference input for supplying a reference voltage, characterized in that the control device comprises a control amplifier which is fed from a current bank having at least one constant current source, an actual value input of said control amplifier receiving the voltage between the output terminals of the power supply source, and a nominal value input receiving the reference voltage from the reference input of the control device, in that an output of the control amplifier constitutes the output of the control device, and in that the control device comprises a preliminary current stage which, dependent on the difference between the voltages at the actual value input and at the nominal value input of the control amplifier, applies a preliminary current to said control amplifier, which preliminary current is applied to the control input of the semiconductor component at least partly via the output of the control device.

2. A controlled power supply source as claimed in claim 1, characterized in that the preliminary current stage supplies the preliminary current when the voltage at the actual value input exceeds the voltage at the nominal value input by a predetermined difference.

3. A controlled power supply source as claimed in claim 1, characterized in that the preliminary current stage is fed from one of the constant current sources of the current bank.

4. A controlled power supply source as claimed in claim 1, characterized in that the control amplifier comprises an emitter-coupled pair of transistors fed by at least one of the constant current sources of the current bank, one of said transistors being controlled by the actual value input and the other being controlled by the nominal value input, and a current combination stage which applies the sum of the currents conveyed by the transistors to the output of the control device.

5. A controlled power supply source as claimed in claim 4, characterized in that, for each transistor of the emitter-coupled pair, the control amplifier comprises an emitter-follower stage fed by a respective constant current source of the current bank, via which emitter-follower stage the actual value input and the nominal value input are connected to the transistors of the emitter-coupled pair controlled by said inputs, and in that the preliminary current stage comprises a diode arrangement which is connected, in the forward direction, by the constant current source of the emitter-follower stage connected to the actual value input, to the emitter of that transistor of the emitter-coupled pair which is controlled by the nominal value input.

6. A controlled power supply source as claimed in claim 1, characterized in that the current bank comprises further constant current sources for supplying further groups of components, particularly further control devices for further controlled power supply sources.

7. A controlled power supply source as claimed in claim 2, characterized in that the preliminary current stage is fed from one of the constant current sources of the current bank.

8. A controlled power supply source as claimed in claim 2, characterized in that the control amplifier comprises an emitter-coupled pair of transistors fed by at least one of the constant current sources of the current bank, one of said transistors being controlled by the actual value input and the other being controlled by the nominal value input, and a current combination stage which applies the sum of the currents conveyed by the transistors to the output of the control device.

9. A controlled power supply source as claimed in claim 3, characterized in that the control amplifier comprises an emitter-coupled pair of transistors fed by at least one of the constant current sources of the current bank, one of said transistors being controlled by the actual value input and the other being controlled by the nominal value input, and a current combination stage which applies the sum of the currents conveyed by the transistors to the output of the control device.

10. A controlled power supply source as claimed in claim 8, characterized in that, for each transistor of the emitter-coupled pair, the control amplifier comprises an emitter-follower stage fed by a respective constant current source of the current bank, via which emitter-follower stage the actual value input and the nominal value input are connected to the transistors of the emitter-coupled pair controlled by said inputs, and in that the preliminary current stage comprises a diode arrangement which is connected, in the forward direction, by the constant current source of the emitter-follower stage connected to the actual value input, to the emitter of that transistor of the emitter-coupled pair which is controlled by the nominal value input.

11. A controlled power supply source as claimed in claim 9, characterized in that, for each transistor of the emitter-coupled pair, the control amplifier comprises an emitter-follower stage fed by a respective constant current source of the current bank, via which emitter-follower stage the actual value input and the nominal value input are connected to the transistors of the emitter-coupled pair controlled by said inputs, and in that the preliminary current stage comprises a diode arrangement which is connected, in the forward direction, by the constant current source of the emitter-follower stage connected to the actual value input, to the emitter of that transistor of the emitter-coupled pair which is controlled by the nominal value input.

12. A controlled power supply source as claimed in claim 2, characterized in that the current bank comprises further constant current sources for supplying further groups of components, particularly further control devices for further controlled power supply sources.

13. A controlled power supply source as claimed in claim 3, characterized in that the current bank comprises further constant current sources for supplying further groups of components, particularly further control devices for further controlled power supply sources.

14. A controlled power supply source as claimed in claim 4, characterized in that the current bank comprises further constant current sources for supplying further groups of components, particularly further control devices for further controlled power supply sources.

15. A controlled power supply source as claimed in claim 5, characterized in that the current bank comprises further constant current sources for supplying further groups of components, particularly further control devices for further controlled power supply sources.

16. A controlled power supply source as claimed in claim 7, characterized in that the current bank comprises further constant current sources for supplying further groups of components, particularly further control devices for further controlled power supply sources.

17. A controlled power supply source as claimed in claim 8, characterized in that the current bank comprises further constant current sources for supplying further groups of components, particularly further control devices for further controlled power supply sources.

18. A controlled power supply source as claimed in claim 9, characterized in that the current bank comprises further constant current sources for supplying further groups of components, particularly further control devices for further controlled power supply sources.

19. A controlled power supply source as claimed in claim 10, characterized in that the current bank comprises further constant current sources for supplying further groups of components, particularly further control devices for further controlled power supply sources.

20. A controlled power supply source as claimed in claim 11, characterized in that the current bank comprises further constant current sources for supplying further groups of components, particularly further control devices for further controlled power supply sources.

* * * * *